US010648444B2

(12) United States Patent
Lorenz et al.

(10) Patent No.: US 10,648,444 B2
(45) Date of Patent: May 12, 2020

(54) METHOD AND APPARATUS TO CONTROL AN IGNITION SYSTEM

(71) Applicant: Delphi Automotive Systems Luxembourg SA, Bascharage (LU)

(72) Inventors: Frank Lorenz, Trier (DE); Peter Weyand, Bertrange (LU)

(73) Assignee: DELPHI AUTOMOTIVE SYSTEMS LUXEMBOURG SA, Bascharage (LU)

( * ) Notice: Subject to any disclaimer, the term of this patent is extended or adjusted under 35 U.S.C. 154(b) by 73 days.

(21) Appl. No.: 15/774,513

(22) PCT Filed: Nov. 8, 2016

(86) PCT No.: PCT/EP2016/076981
§ 371 (c)(1),
(2) Date: May 8, 2018

(87) PCT Pub. No.: WO2017/081005
PCT Pub. Date: May 18, 2017

(65) Prior Publication Data

US 2019/0301422 A1 Oct. 3, 2019

(30) Foreign Application Priority Data

Nov. 9, 2015 (GB) ..... 1519702.3

(51) Int. Cl.
*F02P 9/00* (2006.01)
*F02P 15/10* (2006.01)

(52) U.S. Cl.
CPC ..... *F02P 9/007* (2013.01); *F02P 15/10* (2013.01)

(58) Field of Classification Search
CPC .. C08F 4/65927; C08F 4/64148; C08F 10/02; C08F 8/30; C08F 8/42; C08F 2500/15; C08F 4/65908; C08F 110/02; C08F 2420/02; C08F 4/659; C08F 4/65912; C08F 4/602; C08F 4/64; C08F 4/65916
See application file for complete search history.

(56) References Cited

U.S. PATENT DOCUMENTS 3,218,512 A * 11/1965 Quinn ..... F02P 3/0435 315/212
3,280,809 A 10/1966 Issler
(Continued)

FOREIGN PATENT DOCUMENTS

EP 2325476 A1 5/2011
WO 2015071243 A1 5/2015

*Primary Examiner* — Joseph J Dallo
(74) *Attorney, Agent, or Firm* — Joshua M. Haines

(57) ABSTRACT

A multi-charge ignition system includes a spark plug control unit adapted to control at least two coil stages so as to successively energise and de-energise the coil stages to provide a current to a spark plug. The two stages include a first transformer including a first primary winding inductively coupled to a first secondary winding; a second transformer including a second primary winding inductively coupled to a second secondary winding. An auxiliary primary winding is connected from the common high side of the primary winding in series to an auxiliary secondary winding, the other end of said auxiliary secondary winding is electrically connected to ground/low side, and includes a switch which selectively allows current to pass through the auxiliary windings.

7 Claims, 3 Drawing Sheets

(56) References Cited

U.S. PATENT DOCUMENTS

| | | | | | |
|---|---|---|---|---|---|
| 4,117,818 | A * | 10/1978 | Bodig | F02P 3/051 | 123/621 |
| 4,285,322 | A * | 8/1981 | Ina | F02P 3/0552 | 123/630 |
| 4,320,735 | A * | 3/1982 | Canup | F02P 3/01 | 123/606 |
| 4,326,493 | A * | 4/1982 | Merrick | F02P 3/02 | 123/606 |
| 4,356,807 | A * | 11/1982 | Tokura | F02P 3/01 | 123/606 |
| 4,641,626 | A * | 2/1987 | Morino | F02P 9/002 | 123/620 |
| 4,702,221 | A | 10/1987 | Tokura et al. | | |
| 4,947,821 | A * | 8/1990 | Somiya | F02P 3/005 | 123/606 |
| 5,211,152 | A * | 5/1993 | Alexandrov | F02P 3/0554 | 123/620 |
| 5,548,471 | A * | 8/1996 | Roederer | F02P 3/01 | 361/253 |
| 5,806,504 | A * | 9/1998 | French | F02P 9/007 | 123/605 |
| 6,328,025 | B1 | 12/2001 | Marrs | | |
| 6,352,069 | B1 | 3/2002 | Kraus et al. | | |
| 6,997,171 | B1 * | 2/2006 | Naruse | F02P 3/05 | 123/609 |
| 7,681,562 | B2 * | 3/2010 | Boerjes | F02P 3/053 | 123/595 |
| 9,399,979 | B2 * | 7/2016 | Heise | F02P 3/0442 | |
| 2015/0192100 | A1 | 7/2015 | Kurahashi et al. | | |

* cited by examiner

METHOD AND APPARATUS TO CONTROL AN IGNITION SYSTEM

CROSS REFERENCE TO RELATED APPLICATIONS

This application is a national stage application under 35 USC 371 of PCT Application No. PCT/EP2016/076981 having an international filing date of Nov. 8, 2016, which is designated in the United States and which claimed the benefit of GB Patent Application No. 1519702.3 filed on Nov. 9, 2015, the entire disclosures of each are hereby incorporated by reference in their entirety.

TECHNICAL FIELD

The present invention relates to an ignition system and method of controlling spark plugs. It has particular but not exclusive application to systems which are adapted to provide a continuous spark, such as a multi-spark plug ignition system.

BACKGROUND OF THE INVENTION

Ignition engines that use very lean air-fuel mixtures have been developed, that is, having a higher air composition to reduce fuel consumption and emissions. In order to provide a safe ignition it is necessary to have a high energy ignition source. Prior art systems generally use large, high energy, single spark ignition coils, which have a limited spark duration and energy output. To overcome this limitation and also to reduce the size of the ignition system multi-charge ignition systems have been developed. Multi-charge systems produce a fast sequence of individual sparks, so that the output is a long quasi-continuous spark. Multi-charge ignition methods have the disadvantage that the spark is interrupted during the recharge periods, which has negative effects, particularly noticeable when high turbulences are present in the combustion chamber. For example this can lead to misfire, resulting in higher fuel consumption and higher emissions.

An improved multi-charge system is described in European Patent EP2325476 which discloses a multi-charge ignition system without these negative effects and, at least partly, producing a continuous ignition spark over a wide area of burn voltage, delivering an adjustable energy to the spark plug and providing with a burning time of the ignition fire that can be chosen freely.

One drawback of current systems is the high primary current peak at the initial charge. That current peak is unwanted, it generates higher copper-losses, higher EMC-Emissions and acts as a higher load for the onboard power generation (generator/battery) of the vehicle. One option to minimize the high primary current peak is a DC/DC converter in front of the ignition coil (e.g. 48 V). However this introduces extra cost.

It is an object of the invention to minimize the high primary current peak without the use of a DC/DC converter.

STATEMENT OF THE INVENTION

In one aspect is provided a multi-charge ignition system including a spark plug control unit adapted to control at least two coil stages so as to successively energise and de-energise said coil stage(s) to provide a current to a spark plug, said two stages comprising a first transformer (T1) including a first primary winding (L1) inductively coupled to a first secondary winding (L2); a second transformer (T2) including a second primary winding (L3) inductively coupled to a second secondary winding (L4); characterised in including auxiliary primary winding (L1') connected from the common high side of the primary winding in series to an auxiliary secondary winding (L2'), the other end of said auxiliary secondary winding (L2') electrically connected to ground/low side, and including switch means Q3 adapted to selectively allow current to pass through said auxiliary windings.

The system may including a step-down converter stage located between said control unit and coil stage(s), said step-down converter including a third switch (M1) and a diode (D3), said control unit being enabled to control said third switch to selectively provide power to said coil stages.

The said switch means Q3 may be controlled by said control unit.

Said switch means may be is located between the low side end of the auxiliary secondary winding and ground.

Said control unit may be enabled to simultaneously energize and de-energize primary windings (L1, L3) by simultaneously switching on and off two said corresponding fourth and fifth switches (Q1, Q2) to sequentially energize and de-energize primary windings (L1, L3) by sequentially switching on and off both corresponding switches (Q1, Q2) to maintain a continuous ignition fire.

In a multi-charge ignition cycle, during an initial energization/ramp-up phase of said primary coil of said first stage, said control unit may be adapted to close said switch Q3 to current to flow through said auxiliary primary windings.

Also provided is a method of controlling the above systems comprising, during an initial energisation/ramp-up phase of said primary coil of said first stage in a multi-charge ignition cycle, allowing current to flow through said auxiliary primary windings.

BRIEF DESCRIPTION OF DRAWINGS

The invention will now be described by way of example and with reference to the following figures of which.

DETAILED DESCRIPTION OF EXAMPLES

Figure 1:
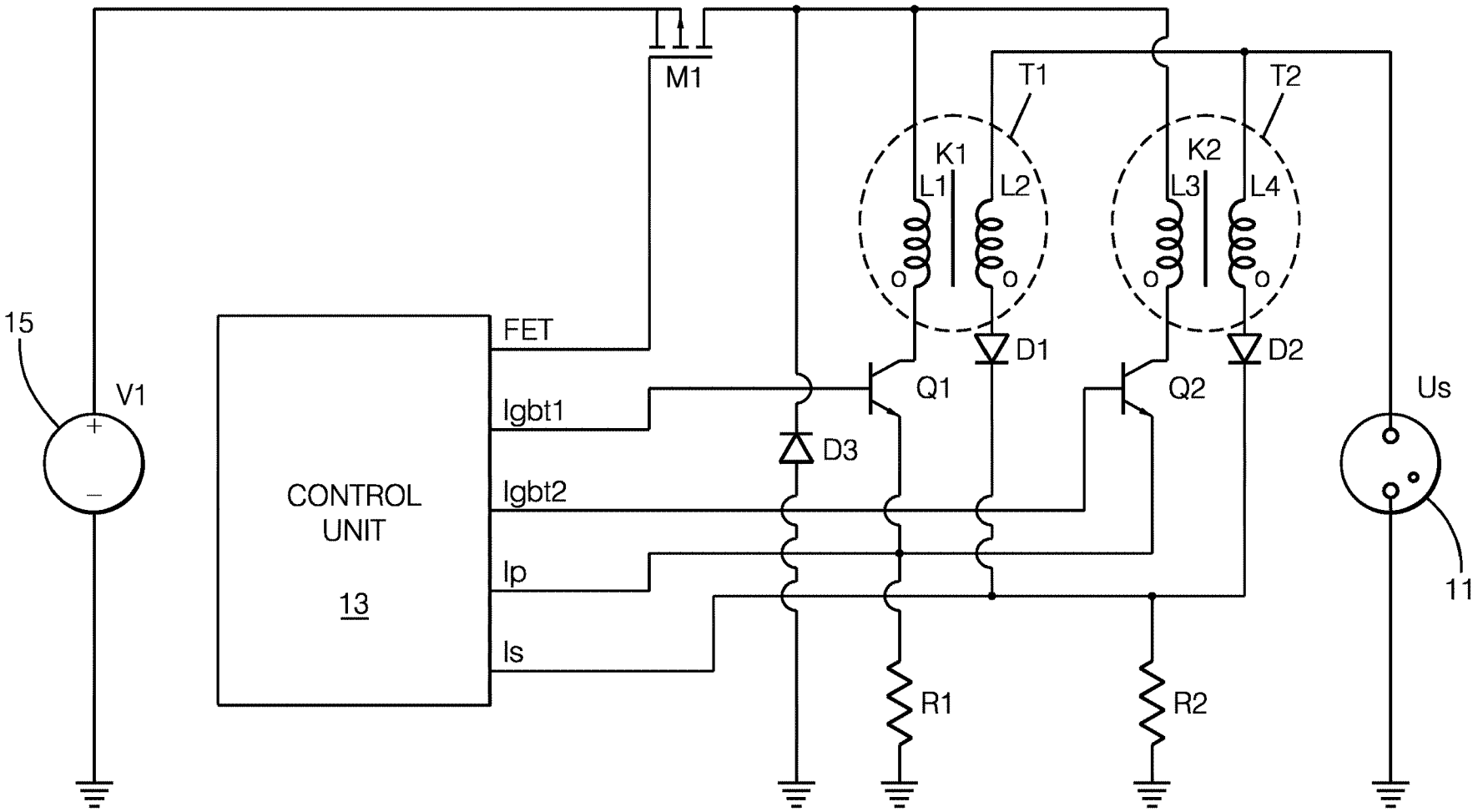
FIG. 1 shows the circuitry of a prior art coupled-multi-charge ignition system.

FIG. 1 shows the circuitry of a prior art coupled-multi-charge ignition system for producing a continuous ignition spark over a wide area of burn voltage servicing a single set of gapped electrodes in a spark plug 11 such as might be associated with a single combustion cylinder of an internal combustion engine (not shown). The CMC system uses fast charging ignition coils (L1-L4), including primary windings, L1, L2 to generate the required high DC-voltage. L1 and L2 are wound on a common core K1 forming a first transformer (coil stage) and secondary windings L3, L4 wound on another common core K2 are forming a second transformer (coil stage). The two coil ends of the first and second primary windings L1, L3 may be alternately switched to a common ground such as a chassis ground of an automobile by electrical switches Q1, Q2. These switches Q1, Q2 are preferably Insulated Gate Bipolar Transistors. Resistor R1 may be optionally present for measuring the primary current Ip that flows from the primary side and is connected between the switches Q1, Q2 and ground, while optional resistor R2 for measuring the secondary current Is that flows from the secondary side is connected between the diodes D1, D2 and ground.

The low-voltage ends of the secondary windings L2, L4 may be coupled to a common ground or chassis ground of an automobile through high-voltages diodes D1, D2. The high-voltage ends of the secondary ignition windings L2, L4 are coupled to one electrode of a gapped pair of electrodes in a spark plug 11 through conventional means. The other electrode of the spark plug 11 is also coupled to a common ground, conventionally by way of threaded engagement of the spark plug to the engine block. The primary windings L1, L3 are connected to a common energizing potential which may correspond to conventional automotive system voltage in a nominal 12V automotive electrical system and is in the figure the positive voltage of battery. The charge current can be supervised by an electronic control circuit 13 that controls the state of the switches Q1, Q2. The control circuit 13 is for example responsive to engine spark timing (EST) signals, supplied by the ECU, to selectively couple the primary windings L1 and L2 to system ground through switches Q1 and Q2 respectively controlled by signals Igbt1 and Igbt2, respectively. Measured primary current Ip and secondary current Is may be sent to control unit 13. Advantageously, the common energizing potential of the battery 15 may be coupled by way of an ignition switch M1 to the primary windings L1, L3 at 20 the opposite end that the grounded one. Switch M1 is preferably a MOSFET transistor. A diode D3 or any other semiconductor switch (e.g. MOSFET) is coupled to transistor M1 so as to form a step-down converter. Control unit 13 is enabled to switch off switch M1 by means of a signal FET. The diode D3 or any other semiconductor switch will be switched on when M1 is off and vice versa.

In prior art operation, the control circuit 13 is operative to provide an extended continuous high-energy arc across the gapped electrodes. During a first step, switches M1, Q1 and Q2 are all switched on, so that the delivered energy of the power supply 15 is stored in the magnetic circuit of both transformers (T1, T2). During a second step, both primary windings are switched off at the same time by means of switches Q1 and Q2. On the secondary side of the transformers a high voltage is induced and an ignition spark is created through the gapped electrodes of the spark plug 11. During a third step, after a minimum burn time wherein both transformers (T1, T2) are delivering energy, switch Q1 is switched on and switch Q2 is switched off (or vice versa). That means that the first transformer (L1, L2) stores energy into its magnetic circuit while the second transformer (L3, L4) delivers energy to spark plug (or vice versa). During a fourth step, when the primary current Ip increases over a limit (Ipmax), the control unit detects it and switches transistor M1 off. The stored energy in the transformer (L1, L2 or L3, L4) that is switched on (Q1, or Q2) impels a current over diode D3 (step-down topology), so that the transformer cannot go into the magnetic saturation, its energy being limited. Preferably, transistor M1 will be permanently switched on and off to hold the energy in the transformer on a constant level. During a fifth step, just after the secondary current Is falls short of a secondary current threshold level (Ismin) the switch Q1 is switched off and the switch Q2 is switched on (or vice versa). Then steps 3 to 5 will be iterated by sequentially switching on and off switches Q1 and Q2 as long as the control unit switches both switches Q1 and Q2 off.

Figure 2:
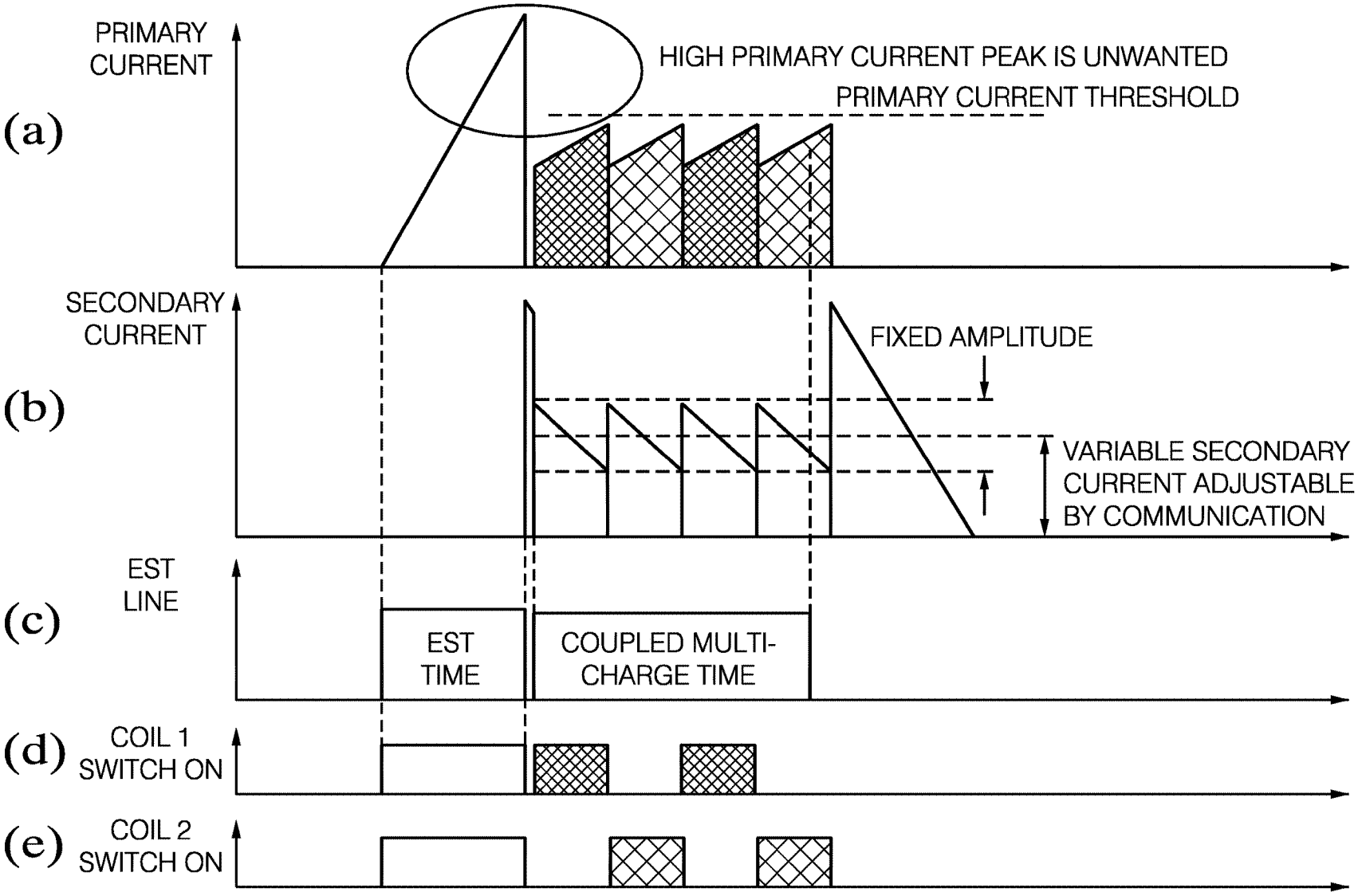
FIG. 2 shows timeline of ignition system current.

FIG. 2 shows timeline of ignition system current; FIG. 2*a* shows a trace representing primary current Ip along time. FIG. 2*b* shows the secondary current Is. FIG. 2*c* shows the signal on the EST line which is sent from the ECU to the ignition system control unit and which indicates ignition time. During step 1, i.e. M1, Q1 and Q2 switched on, the primary current Ip is increasing rapidly with the energy storage in the transformers. During step 2, i.e. Q1 and Q2 switched off, the secondary current Is is increasing and a high voltage is induced so as to create an ignition spark through the gapped electrodes of the spark plug. During step 3, i.e. Q1 and Q2 are switched on and off sequentially, so as to maintain the spark as well as the energy stored in the transformers. During step 4, comparison is made between primary current Ip and a limit Ipth. When Ip exceeds Ipth M1 is switched off, so that the "switched on" transformer cannot go into the magnetic saturation, by limiting its stored energy. The switch M1 is switched on and off in this way, that the primary current Ip is stable in a controlled range. During step 5, comparison is made between the secondary current is and a secondary current threshold level Isth. If Is<Isth, Q1 is switched off and Q2 switched on (or vice versa). Then steps 3 to 5 will be iterated by sequentially switching on and off Q1 and Q2 as long as the control unit switches both Q1 and Q2 off. Because of the alternating charging and discharging of the two transformers the ignition system delivers a continuous ignition fire. The above describes the circuitry and operation of a prior art ignition system to provide a background to the current invention. In some aspects of the invention the above circuitry can be used. The invention provides various solutions to enhance performance and reduce spark-plug wear. FIGS. 2*d* and *e* show the operating states of the respective coils.

DETAILED DESCRIPTION OF THE INVENTION

Figure 3:
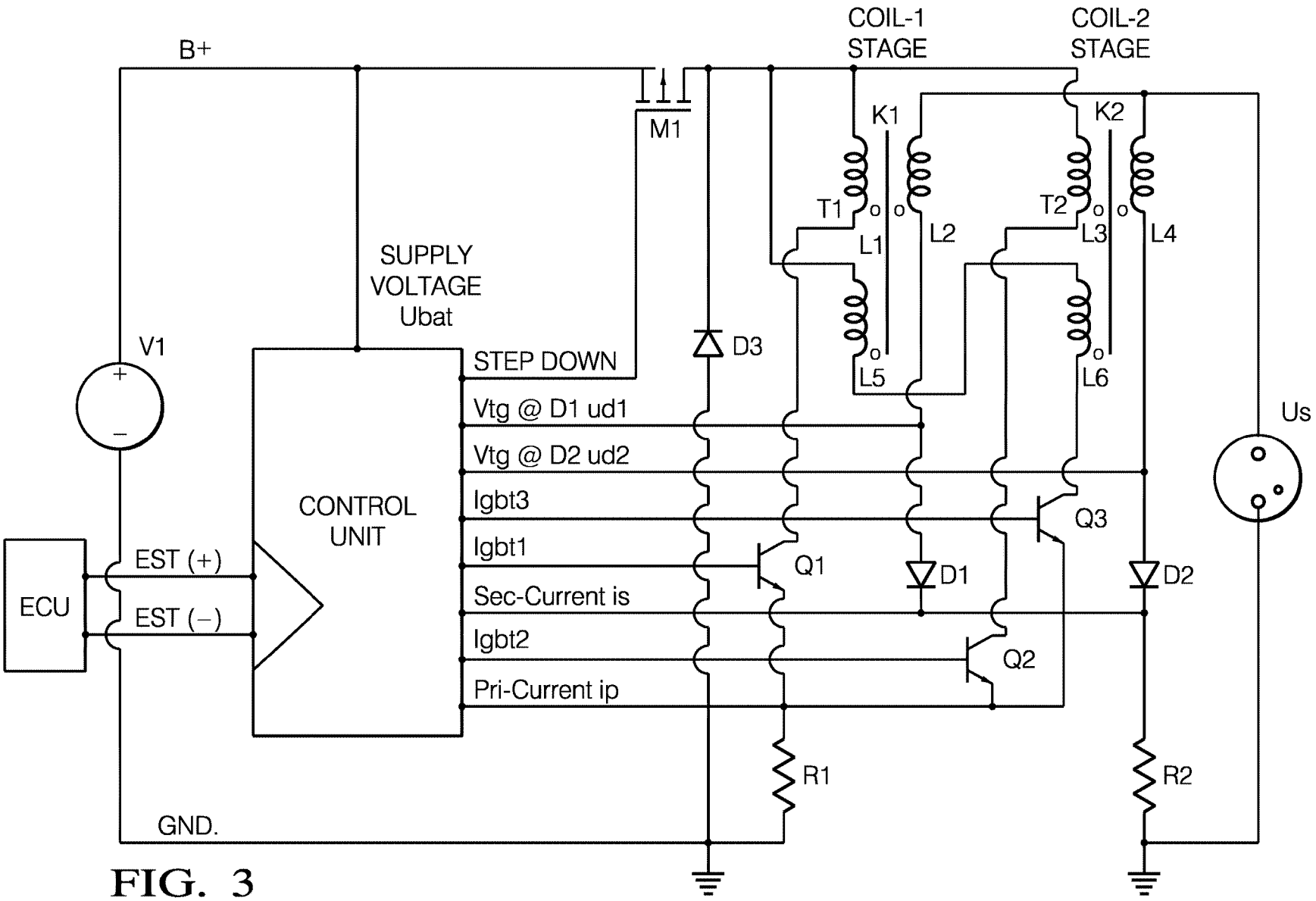
FIG. 3 shows one example of the invention.

FIG. 3 shows one example of the invention. It is similar to FIG. 1 except there is provided an additional (auxiliary) primary windings L5 and L6 on each transformer (coil stage) so as to provide inductive coupling, and which are connected in series. Further an additional switch Q3 is provided between the low side of the transformer L6 and ground. The switch may be controlled by an output from the controller. It is to be noted that the connection to the engine ECU is shown in this figure. Thus L1 L5 and L6 share common core K1 and L3 L4 and L6 share common core K2.

In operation during the initial phase of a multi-charge ignition cycle, the windings are connected in series by closing the switch Q3. After the initial operation the switch Q3 is opened during standard CMC operation and toggling of both transformer stages is controlled by switches Q1 and Q3.

The invention claimed is:

1. A multi-charge ignition system comprising:

at least two coil stages comprising a first transformer including a first primary winding inductively coupled to a first secondary winding and a second transformer including a second primary winding inductively coupled to a second secondary winding;

a first auxiliary primary winding connected from a common high side of the first primary winding and of the second primary winding in series to one end of a second auxiliary primary winding, another end of the second auxiliary primary winding electrically connected to ground/low side;

a switch which selectively allows current to pass through the auxiliary primary winding and the auxiliary secondary winding; and a spark plug control unit which controls the at least two coil stages so as to successively energise and de-energise the at least two coil stages to provide a current to a spark plug.

2. As multi-charge ignition system as claimed in claim 1 further comprising a step-down converter stage located between the spark plug control unit and the at least two coil stages, the step-down converter stage including a second switch and a diode, the spark plug control unit being enabled to control the second switch to selectively provide power to the at least two coil stages.

3. A multi-charge ignition system as claimed in claim 1, wherein the switch is controlled by the spark plug control unit.

4. A multi-charge ignition system as claimed in claim 1, wherein the switch is electrically connected between a low side end of the second auxiliary primary winding and ground.

5. A multi-charge ignition system as claimed in claim 1, where the spark plug control unit is enabled to simultaneously energize and de-energize the first primary winding and the second primary winding by simultaneously switching on and off a third switch and a fourth switch to sequentially energize and de-energize the first primary winding and the second primary winding by sequentially switching on and off both the third and fourth switches to maintain a continuous ignition fire.

6. A multi-charge ignition system as claimed in claim 1, wherein in a multi-charge ignition cycle, during an initial energization/ramp-up phase of the first primary winding, the spark plug control unit is adapted to close the switch Q3 to allow current to flow through the first auxiliary primary winding and through the second auxiliary primary winding.

7. A method of controlling a multi-charge ignition system having at least two coil stages comprising a first transformer including a first primary winding inductively coupled to a first secondary winding and a second transformer including a second primary winding inductively coupled to a second secondary winding; a first auxiliary primary winding connected from a common high side of the first primary winding and of the second primary winding in series to one end of a second auxiliary primary winding, another end of the second auxiliary primary winding electrically connected to ground/low side; a switch Q3 which selectively allows current to pass through the auxiliary primary winding and the auxiliary secondary winding; and a spark plug control unit which controls the at least two coil stages so as to successively energise and de-energise the at least two coil stages to provide a current to a spark plug, the method comprising:

during an initial energisation/ramp-up phase of the first primary winding in a multi-charge ignition cycle, allowing current to flow through the first auxiliary primary winding and through the second auxiliary primary winding.

* * * * *